United States Patent [19]

Hart

[11] Patent Number: 5,067,721

[45] Date of Patent: Nov. 26, 1991

[54] METHOD AND APPARATUS FOR PLAYING A PRESIDENTIAL BOARD GAME

[76] Inventor: Robert W. Hart, 105 S.W. 2nd St., Apt. 103, Corvallis, Oreg. 97333

[21] Appl. No.: 550,061

[22] Filed: Jul. 9, 1990

[51] Int. Cl.[5] ..... A63F 3/00

[52] U.S. Cl. ..... 273/243; 273/430

[58] Field of Search ..... 273/242, 243, 257, 279, 273/430, 431

[56] References Cited

U.S. PATENT DOCUMENTS

| | | | |
|---|---|---|---|
| 999,913 | 8/1911 | Todd | 273/300 |
| 2,930,621 | 3/1960 | Gross et al. | 273/257 |
| 4,557,485 | 12/1985 | Landon | 273/249 Xa |
| 4,856,780 | 8/1989 | Begley et al. | 273/244 |
| 4,889,345 | 12/1989 | Wawryk | 273/249 |

OTHER PUBLICATIONS

"Trivial Pursuit" Horn Abbot Ltd., Selchow & Righter Co., ©1981.

"Meet the Presidents", 100th Anniversary Game Catalog, Selchow & Righter Co.

*Primary Examiner*—Edward M. Coven

*Assistant Examiner*—William E. Stoll

*Attorney, Agent, or Firm*—Leon Gilden

[57] ABSTRACT

A board game including a planar board surface, with a perimeter path defined by forty spaces. Each of the spaces corresponds to one of the forty terms of the Presidents, from George Washington through Ronald Reagan, inclusively. A die indicates travel of each player about the path of spaces, with a landing upon a space requiring answering of a question associated with that President, whereupon a correct response results in award of points, and wherein the points are awarded based on the Presidential term in office. Each player is afforded a turn, and a player to achieve a predetermined score is declared a winner.

3 Claims, 6 Drawing Sheets

FIG 7
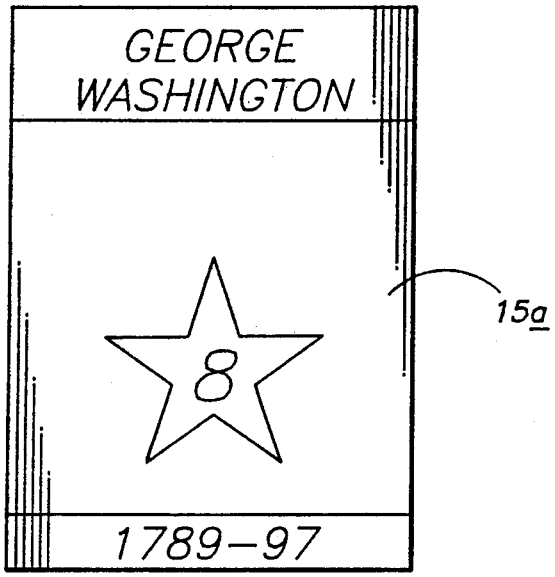
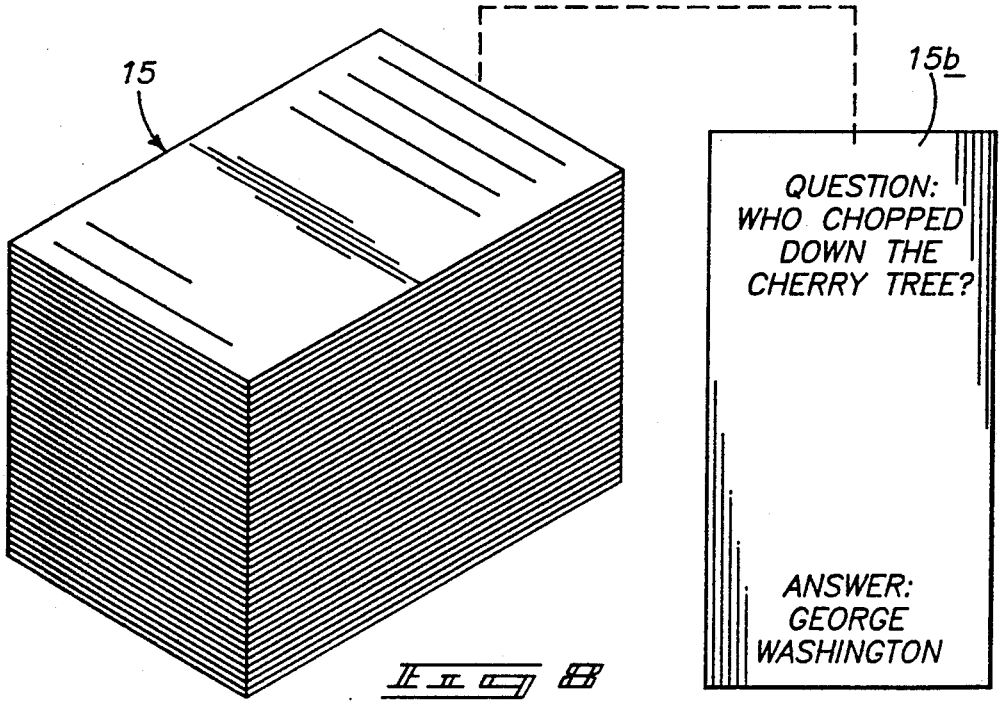
FIG 8

METHOD AND APPARATUS FOR PLAYING A PRESIDENTIAL BOARD GAME

BACKGROUND OF THE INVENTION

1. Field of the Invention

The field of invention relates to board games, and more particularly pertains to a new and improved method and apparatus for playing a Presidential board game to invite players to correctly associate questions regarding a particular President for awarding of points thereby.

2. Description of the Prior Art

Various board games have been set forth in the prior art to accommodate various themes in their operation. The instant invention addresses the educational and entertainment aspects of play to enhance knowledge and impart an element of chance in the playing of a board game to acquaint various individuals with factual data regarding the Presidential history of the United States. Examples of board games may be found in U.S. Pat. No. 3,892,409 to Herbert, Jr. wherein the board game employs a board divided into squares for reception of tiles, wherein the tiles are to be associated by category with the squares of the board game board.

U.S. Pat. No. 4,378,941 to Derby sets forth an educational board game to improve skills of players in the understanding of bird watching.

U.S. Pat. No. 3,942,800 to Holbrook provides a board game utilizing an archeological theme for locating an ancient buried civilization utilizing various clues to direct movement of play within the board game.

U.S. Pat. No. 4,413,828 to Gardner utilizes a board game including cards bearing a numerical indicia associated with further indicia on the board game to conduct tests between player lead cards supported by cards in a particular supporting location, wherein losing cards are removed from the board.

U.S. Pat. No. 4,640,513 to Montijo provides an educational game of skill and memory, wherein the game board is divided into various groups to permit players to take turns in spelling pronouncing, and defining words correctly and remembering number sequences, as well as answering question cards and the like during play of the game.

As such, it may be appreciated that there continues to be a need for a new and improved method and apparatus for playing a Presidential board game wherein the same enhances knowledge and effects amusement between opponents in the understanding and association of various factual data relating to the completed terms of office of Presidents of the United States.

SUMMARY OF THE INVENTION

In view of the foregoing disadvantages inherent in the known types of board games now present in the prior art, the present invention provides a method and apparatus for playing a Presidential board game wherein the same effects association of factual data related to understanding of Presidential history of the United States. As such, the general purpose of the present invention, which will be described subsequently in greater detail, is to provide a new and improved method and apparatus for playing a Presidential board game which has all the advantages of the prior art board games and none of the disadvantages.

To attain this, the present invention provides a board game including a planar board surface, with a perimeter path defined by forty spaces. Each of the spaces corresponds to one of the forty terms of the Presidents, from George Washington through Ronald Reagan, inclusively. A die indicates travel of each player about the path of spaces, with a landing upon a space requiring answering of a question associated with that President, whereupon a correct response results in award of points, and wherein the points are awarded based on the Presidential term in office. Each player is afforded a turn, and a player to achieve a predetermined score is declared a winner.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved method and apparatus for playing a Presidential board game which has all the advantages of the prior art board games and none of the disadvantages.

It is another object of the present invention to provide a new and improved method and apparatus for playing a Presidential board game which may be easily and efficiently manufactured and marketed.

It is a further object of the present invention to provide a new and improved method and apparatus for playing a Presidential board game which is of a durable and reliable construction.

An even further object of the present invention is to provide a new and improved method and apparatus for playing a Presidential board game which is susceptible of a low cost of manufacture with regard to both materials and labor, and which accordingly is then susceptible of low prices of sale to the consuming public, thereby making such methods and apparatus for playing a Presidential board game economically available to the buying public.

Still yet another object of the present invention is to provide a new and improved method and apparatus for playing a Presidential board game which provides in the apparatuses and methods of the prior art some of the advantages thereof, while simultaneously overcoming some of the disadvantages normally associated therewith.

Still another object of the present invention is to provide a new and improved method and apparatus for playing a Presidential board game wherein the same enhances understanding and knowledge of prior Presidential terms of United States Presidents by requiring the association of knowledge of the various Presidents, with chance landing upon squares within the board game associated with that President.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 7 is an orthographic top view of a top surface of a typical playing card utilized by the instant invention.

FIG. 8 is an isometric illustration of the playing cards of the instant invention and representative bottom surface of a playing card of the stack of playing cards.

DESCRIPTION OF THE PREFERRED EMBODIMENT

Figure 1:
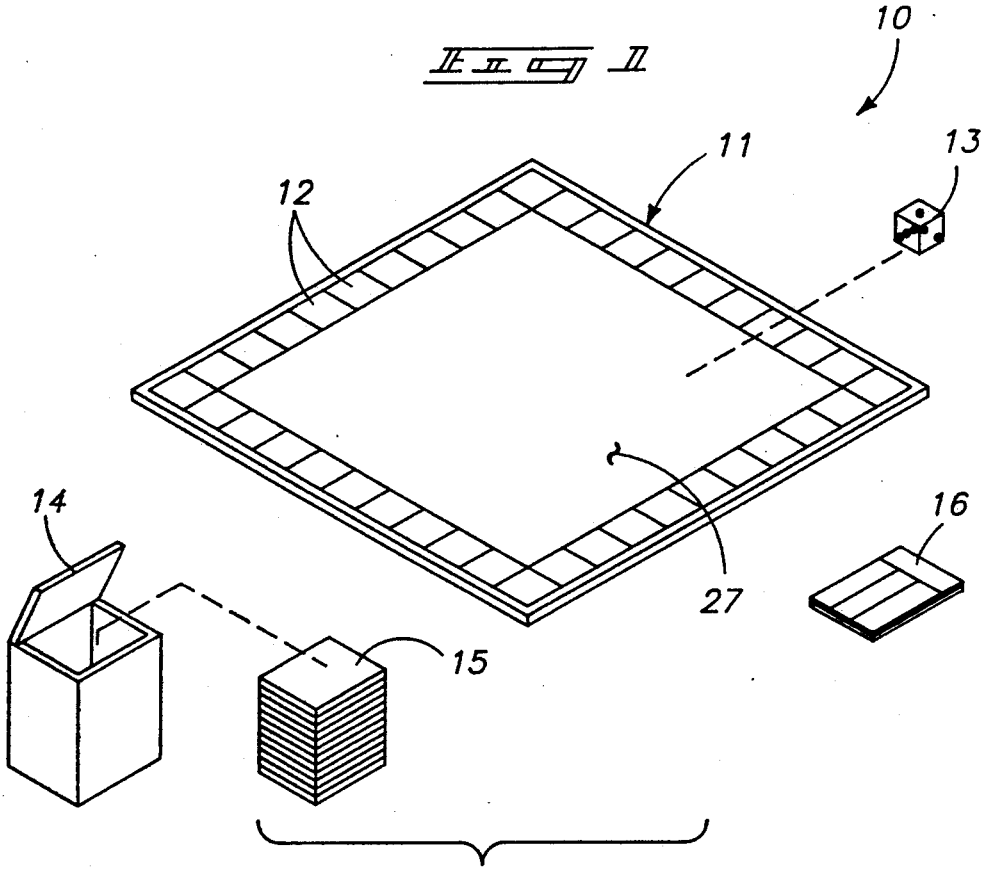
FIG. 1 is an isometric illustration of the various components of the instant invention.

With reference now to the drawings, and in particular to FIGS. 1 to 8 thereof, a new and improved method and apparatus for playing a Presidential board game embodying the principles and concepts of the present invention and generally designated by the reference numeral 10 will be described.

More specifically, the method and apparatus for playing a Presidential board game 10 essentially comprises the use of a rigid planar game board 11, including a top surface, with a central board game surface and a perimeter path 12 defined by forty squares that correspond with the forty Presidents of the United States from George Washington through Ronald Reagan sequentially. A single die 13 of a six-sided configuration and of indicia indicating one through six sequentially is utilized to ascertain player movement and to determine the order of play by each of the players. A game card storage container 14, with a securable lid, is provided to complementarily receive a stack of game cards 15. A score pad 16 is provided to keep score of the various players.

Figure 2:
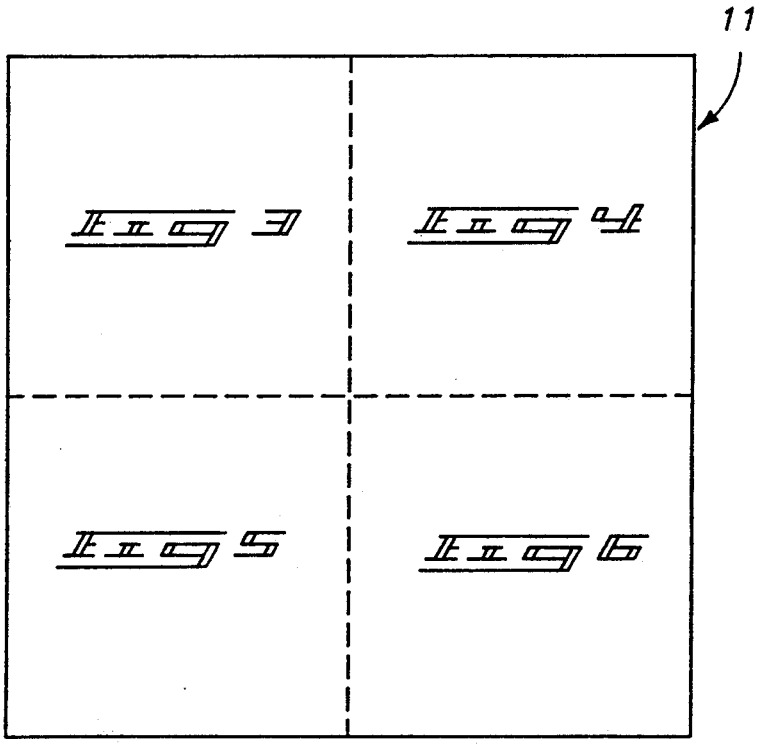
FIG. 2 is a top orthographic view of the playing board diagrammatically set forth.
Figure 3:
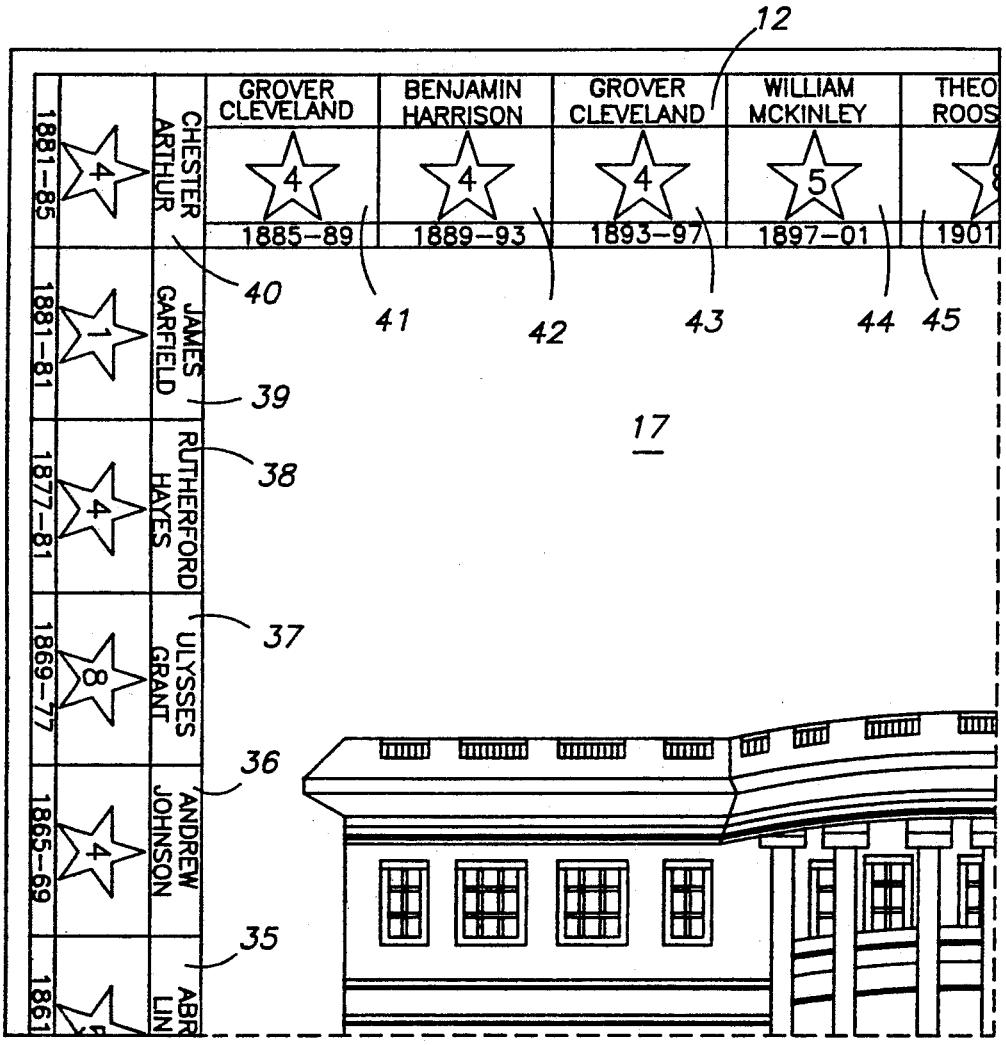
FIG. 3 is an orthographic top view of a representative of FIG. 3 as set forth in FIG. 2.
Figure 4:
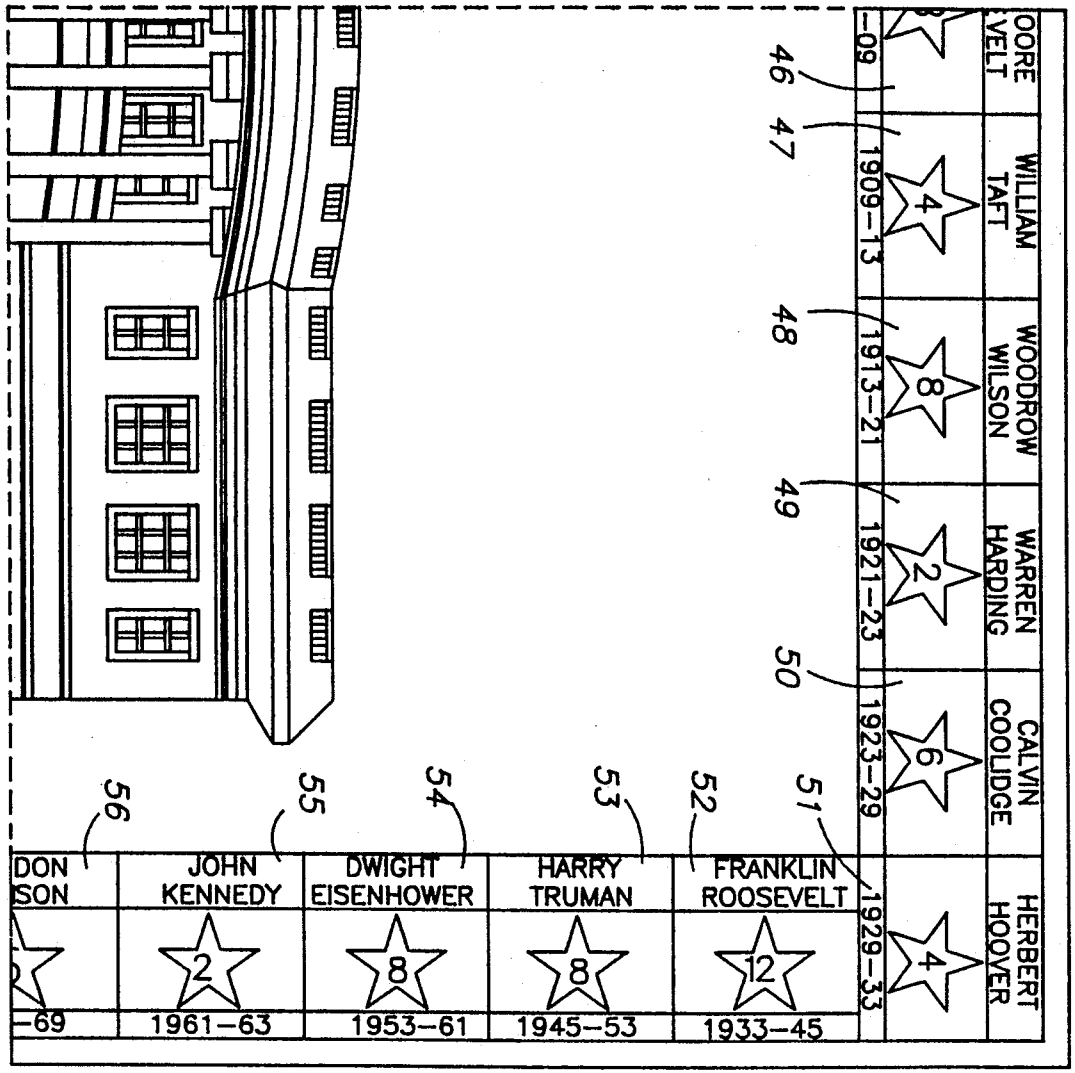
FIG. 4 is an orthographic top view of a representative FIG. 4 as set forth in FIG. 2.
Figure 5:
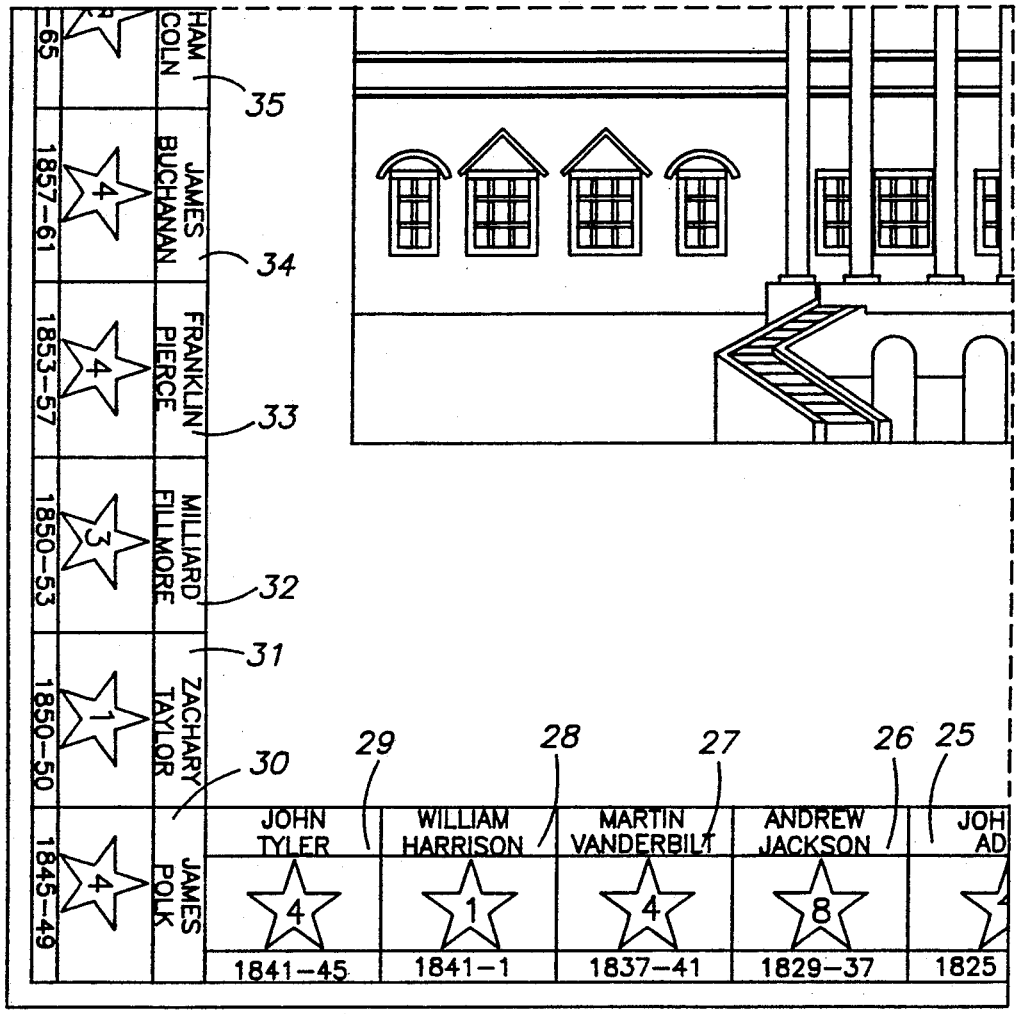
FIG. 5 is an orthographic top view of the representative FIG. 5 as set forth in FIG. 2.
Figure 6:
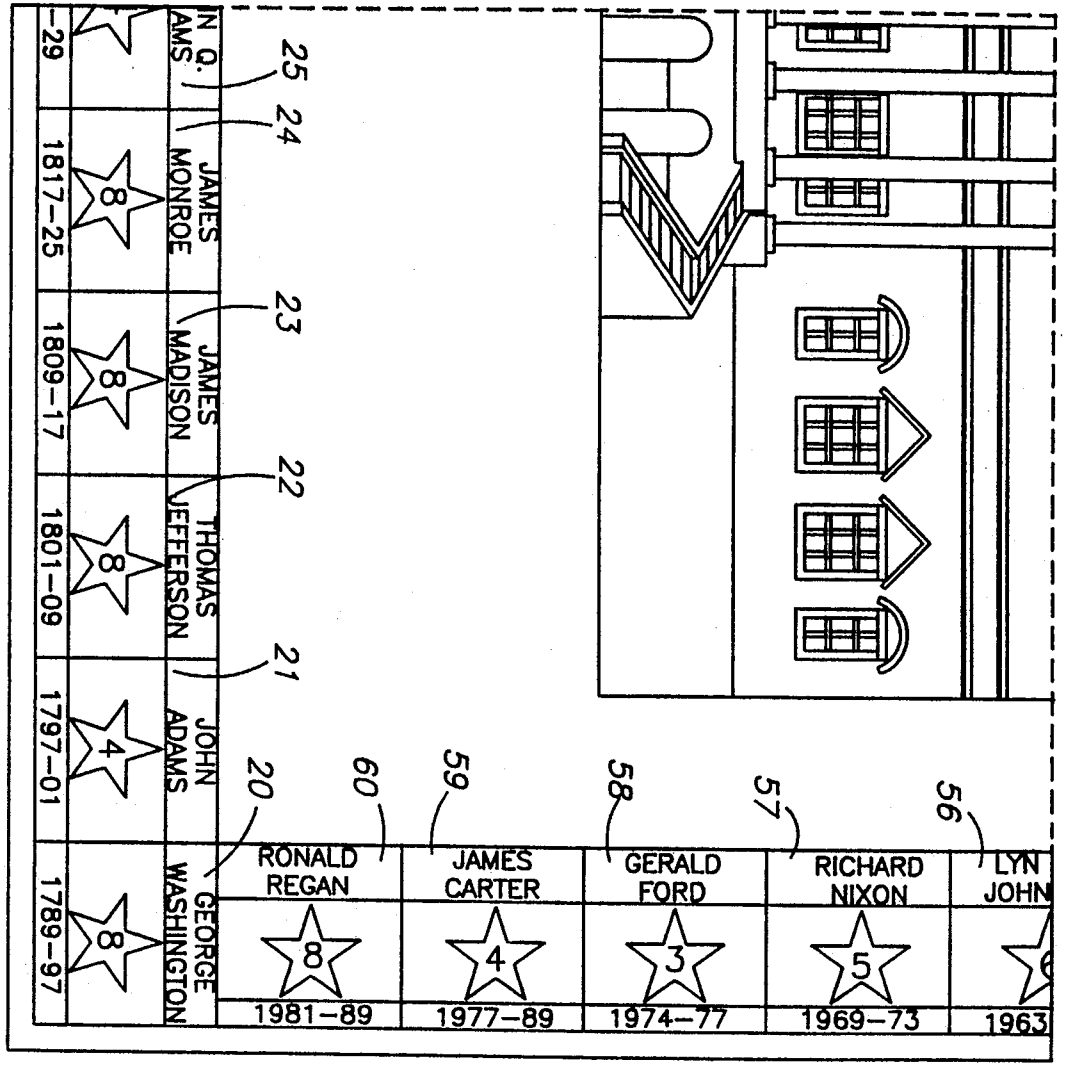
FIG. 6 is an orthographic top view of the representative FIG. 6 as set forth in FIG. 2.

Typically, two to four players are involved in play of the instant game, with the die 13 thrown and the lowest number to originate play. Players are sequentially availed of a turn in a clockwise orientation about the game board 11. Reference to FIG. 2 and the associated FIGS. 3–6 illustrate the game board in detail, with the spaces 20–60 inclusively associated with each of the first through forty Presidents. Medially of each of the Presidential spaces 20–60 is a star provided to indicate the number of years each President was in office as President of the United States. Accordingly, each point total awarded each player upon properly answering a question of one of the game cards 15 is awarded a point score corresponding to the indicated years in office of each President. The die 13 is thrown and each player beginning with the first base 20 to George Washington is directed to traverse the path and answer questions correctly from the game cards 15 until a questions is answered incorrectly, at which time that player's turn ceases and a sequential player initiates that player's turn. Each game card 15 (see FIGS. 7 and 8) includes a top surface **15*a* to correspond with an associated Presidential space and to duplicate that Presidential space wherein FIG. 7 for example, illustrates the game card associated with the space 20 associated with George Washington further indicating the point total that is correlated to the number of years that President enjoyed the office as President of the United States. The bottom surface 15*b* of each game card of the stack of game cards 15 is provided with a representative question, such as illustrated in FIG. 8, and upon correct response to that question, the player is awarded the point total so indicated on the top surface of the card 15*a* and the associated Presidential space, such as the space 20 associated with George Washington, as illustrated in FIG. 6 for example. The central board surface 17 accommodates the various game cards 15, the score pad 16 and the die 13** for use in play.

A player to achieve a predetermined point total is declared the winner, but it is also provided that each remaining player be afforded a final turn in an attempt to surpass the point total of the initially designated winner. In the event of a tie, each player is randomly questioned from a game card drawn from the stack 15 and the first player to answer correctly wins the game.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A method of a plurality of players playing a Presidential board game, wherein the method comprises the steps of, providing a planar game board, including the step of providing a perimeter path of a predetermined number of spaces about a perimeter of an upper surface of the game board, with a central open space defined within the perimeter path, and providing a single six-sided die, and providing a score pad, and providing a stack of playing cards, wherein the step of providing the playing cards includes forming a predetermined number of cards from said stack of said playing cards to correspond with each space of said predetermined number of spaces, and each card of said predetermined number of cards including at least one question associated with at least one space of said predetermined number of spaces, and including the step of each player sequentially and initially directing the die onto the open surface of the game board to determine a starting player, and each player sequentially in turn directing the die onto the open surface to direct a player's playing piece onto one of said spaces corresponding to a predetermined die number indicated by said die, and removing a card from said stack of playing cards and answering the at least one question associated with said card and said one of said spaces, and wherein the predetermined number of spaces is formed as forty spaces to correspond with each of forty Presidents of the United States, and wherein the predetermined number of spaces are sequentially arranged from one through forty to correspond with the first through forty Presidents of the United States directly, and forming each of said spaces with an indication of each President and positioning a predetermined number medially of each of said spaces, wherein each predetermined number corresponds to a term of years each of said Presidents has occupied as a term of President in the United States, and wherein a correct response to the question awards each player the predetermined number indicated upon each of said spaces of said perimeter path of the game board.

2. A method of playing a board game as set forth in claim 1 wherein a player to achieve a predetermined point total is effected by totalling each predetermined number awarded upon response to a correct question.

3. A method of playing a board game as set forth in claim 2 wherein each of the predetermined number of cards includes a top surface corresponding to one of said spaces, and a bottom surface including the question associated with one of said spaces, and upon a tie score being effected by said players in totalling of the predetermined numbers awarded by each of said cards, each player associated with the tie score responds to a further question, and a first player to respond correctly to the further question is subsequently awarded the winner of the board game.

* * * * *